US005239831A

United States Patent [19]

Kuroda et al.

[11] Patent Number: 5,239,831

[45] Date of Patent: Aug. 31, 1993

[54] BURNER HAVING ONE OR MORE EDDY GENERATING DEVICES

[75] Inventors: Michio Kuroda; Nobuyuki Iizuka; Haruo Urushidani, All of Hitachi; Kazuhiko Kumata, Katsuta; Isao Sato, Hitachi; Tetsuo Sasada, Hitachi; Hajime Toriya, Hitachi; Yoshikazu Moritomo, Hitachi; Yoji Ishibashi, Hitachi; Takashi Ohmori, Hitachi; Shigeru Azuhata, Hitachi, all of Japan

[73] Assignee: Hitachi, Ltd., Tokyo, Japan

[21] Appl. No.: 727,116

[22] Filed: Jul. 9, 1991

[30] Foreign Application Priority Data

Aug. 20, 1990 [JP] Japan ..... 2-217015

[51] Int. Cl.[5] ..... F02C 1/00

[52] U.S. Cl. ..... 60/733; 60/737; 60/749

[58] Field of Search ..... 60/733, 737, 748, 749

[56] References Cited

U.S. PATENT DOCUMENTS

| | | | |
|---|---|---|---|
| 4,048,797 | 9/1977 | Hakluytt et al. | 60/749 |
| 4,054,028 | 10/1977 | Kawaguchi | 60/749 |
| 4,062,182 | 12/1977 | Fehler et al. | 60/733 |
| 4,078,377 | 3/1978 | Owens et al. | 60/737 |
| 4,199,934 | 4/1980 | Meyer | 60/737 |
| 4,343,147 | 8/1982 | Shekelton | 60/749 |
| 4,455,839 | 6/1984 | Wuchter | 60/737 |
| 4,809,512 | 3/1989 | Barbier et al. | 60/737 |
| 4,898,001 | 2/1990 | Kuroda et al. | 60/737 |

FOREIGN PATENT DOCUMENTS

| | | | |
|---|---|---|---|
| 0218228 | 5/1909 | Fed. Rep. of Germany | 60/749 |
| 64-54122 | 3/1989 | Japan . | |
| 2-40418 | 2/1990 | Japan . | |

*Primary Examiner*—Richard A. Bertsch
*Assistant Examiner*—Michael I. Kocharov
*Attorney, Agent, or Firm*—Antonelli, Terry, Stout & Kraus

[57] ABSTRACT

A burner comprises at least one swirl member for mixing a fuel with an air previously to burning of the fuel, and at least one eddy generating device which is arranged in a flow of a mixture of the fuel and air to generate an eddy flow in the flow so that the eddy flow maintains a shape of a flame of the burned fuel. The at least one eddy generating device is arranged apart from a downstream end of the swirl member by a fixed sufficient distance so that the shape of the flame maintained by the eddy flow is prevented from moving toward the downstream end of the swirler member.

11 Claims, 5 Drawing Sheets

BURNER HAVING ONE OR MORE EDDY GENERATING DEVICES

BACKGROUND OF THE INVENTION AND RELATED ART STATEMENT

The present invention relates to a burner for a gas turbine or the like, and more particularly, to a premix burner in which a fuel is mixed with air before the fuel is burned.

As disclosed by Publications of Japanese Patent Unexamined Publication Nos. 64-54122 and 2-40418, a burner has generally a two-steps burner system for decreasing a density of $NO_x$ so that the fuel is mixed with the air prior to burning of the fuel, when a rated output is obtained. The fuel is mixed with the air prior to burning of the fuel in a second burner by a premix swirler of a premixing device. In order to decrease the density of $NO_x$, an even mixing of the fuel-and-air and a low density of fuel in the mixture are effective. Therefore, the mixing of the fuel-and-air proceeds in a large space and the premix swirl in the premix device accelerates the even mixing. An eddy generating device or flow obstructing member, that is, a flame keeper is arranged near a downstream side of the premix swirler as disclosed in Publication of Japanese Patent Unexamined No. 64-54122 or is movable longitudinally at the downstream side of the premix swirler according to a variation of temperature in the burner as disclosed in of Japanese Patent Unexamined Publication No. 2-40418, and the swirl extends in the premix device to mix the fuel and the air between upstream and downstream sides of the premix device. In the conventional premix burner, a flame is formed and extinguished alternately at a downstream end of the premix swirler so that a vibration is generated in the premix burner and an operation of the premix burner is not stable.

OBJECT AND SUMMARY OF THE INVENTION

The object of the present invention is to provide a burner in which no vibration is generated and the operation is stable.

According to the present invention, a burner comprises at least one swirler member for mixing a fuel with air prior to burning of the fuel, with an eddy generating device being arranged in a flow of a mixture of the fuel and air to generate an eddy flow in the flow so that eddy flow maintains or restrains a shape of a flame of the burned fuel. The eddy generating device is spaced from a downstream end of the swirler member by a fixed sufficient distance so that a shape of the flame is not deformed toward the downstream end of the swirler member.

Since the eddy generating device is spaced from the downstream end of the swirler member by the fixed sufficient distance, although an eddy flow is generated by a termination of the swirler member at the downstream end of the swirler member to maintain the shape of the flame, a force applied to the flame from the eddy flow by the termination of the swirler member for drawing the shape of the flame from the eddy generating device toward the downstream end of the swirler member is small and is always constant in spite of the variation of temperature in the burner so that the shape of the flame is not changed toward the downstream end of the swirl member. Therefore, the vibration of the flame is not generated and the operation of the burner is stable.

DETAILED DESCRIPTION OF PREFERRED EMBODIMENTS

Figure 1:
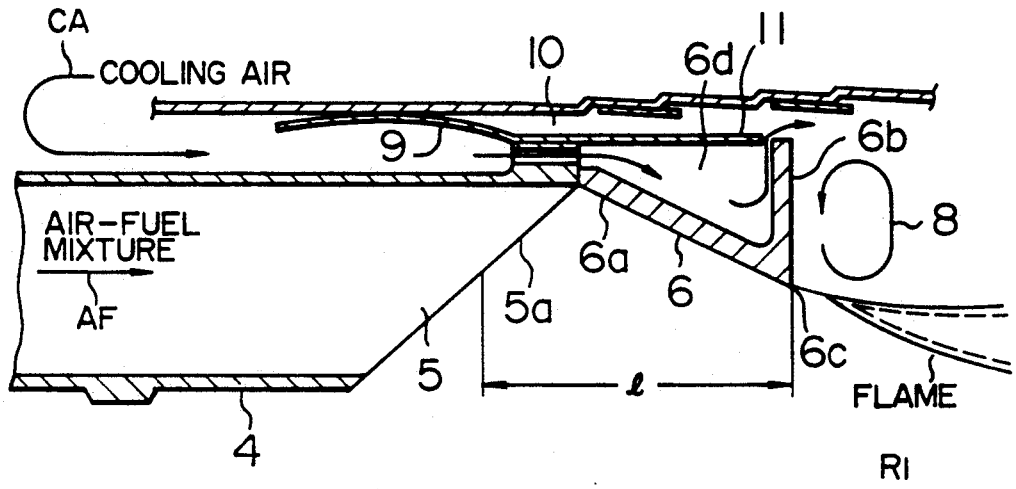
FIG. 1 is a cross-sectional view showing a part of a burner according to the present invention.
Figure 2:
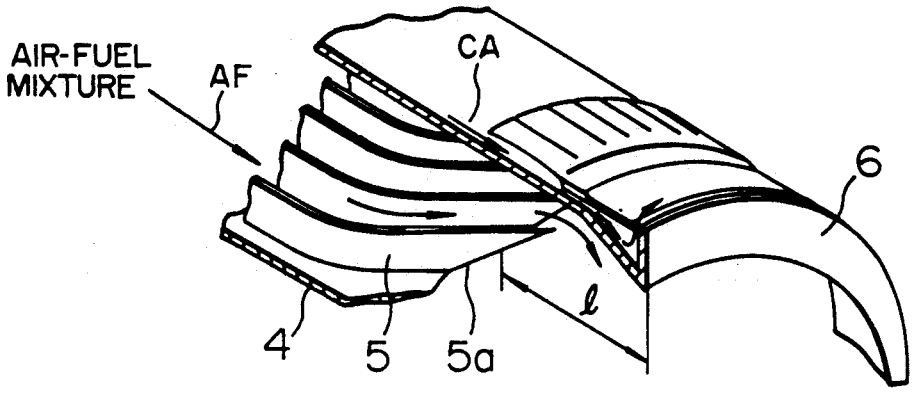
FIG. 2 is an oblique projection and partly-sectional view showing the burner of FIG. 1.
Figure 3:
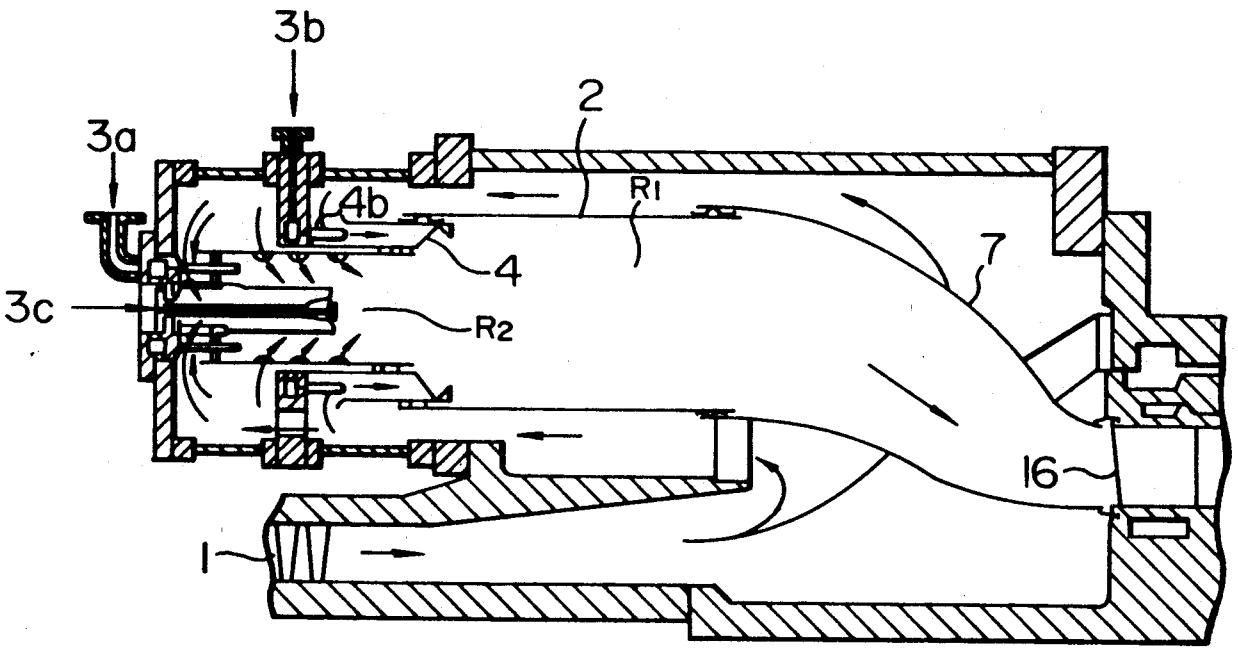
FIG. 3 is a cross-sectional view showing a burner system accomodating a burner according to the present invention.

As shown in FIG. 3, a burner system includes a main burning chamber, R1, a supplementary burning chamber R2, fuel step paths 3*a*, 3*b*, 3*c*, and a premix device 4. Gas turbine vanes 16 are arranged at a downstream side of the main burning chamber R1, and a compressor 1 is arranged at an upperstream side thereof. The premix device 4 is arranged at an upstream radially outer-portion of the main burning chamber R1 and accomodates, as shown in FIG. 1, swirler members 5 for accelerating a mixing between a fuel and an air. A flame keeper (an eddy generating device) 6 is arranged at a downstream side of the premix device 4. A flow path area of the premix device 4 is smaller than that of the flame keeper 6 and a flow speed of the mixture in the premix device 4 is larger than that at the flame keeper 6. The flame keeper 6 is supported on a periphery of an end of the premix device 4 and includes a tapered portion 6*a* and a steep expansion surface 6*b* arranged at a downstream side of the tapered portion 6*a*. The air-fuel mixture, as shown by the arrow AF in FIGS. 1 and 2, flows toward the flame keeper 6 and the steep expansion surface 6*b* (FIG. 1) operates as an eddy starting point 6*c* to generate an eddy 8 at a downstream side of the steep expansion surface 6*b* so that a shape of the flame is maintained or restrained by the eddy 8.

A cooling air path 6*d* is arranged at an outer periphery of the flame keeper 6 and a cooling air CA flows in the cooling air path 6*d* to cool the flame keeper 6 and to be supplied to the main burning chamber R1. It is important that the flame keeper 6 is fixed in relation to the swirler members 5 and the eddy flow starting point 6*c* is spaced from downstream end surfaces 5*a* of the swirler members 5 by a fixed distance 1. In other words, a space is formed between the eddy flow starting point 6*c* and the downstream end surfaces 5*a* of the swirler members 5.

High pressure air from the compressor 1 flows into a liner 2 (FIG. 3) forming the main burning chamber R1 after a flow direction of the high-pressure air is changed in a U-shaped manner. In the burner system, the fuel is supplied to three burning steps through a first step fuel path 3*a*, a second step fuel path 3*b* and a start assisting fuel path 3*c* to be burned. The fuel from the first step fuel path 3*a* is burned mainly in the supplementary burning chamber R2. The fuel from the second step fuel path 3*b* is injected by a second step fuel nozzle 4*b* into the premix device 4 to be mixed with the air flowing from an outer periphery of the premix device 4 and is burned in the main burning chamber R1. The fuel from the start assisting fuel path 3*c* is used only when the burner is started. A gas generated from the main burning chamber R1 flows through a back tube 7 to the gas turbine vanes 16 so that a gas turbine is rotated.

The fuel from the first step fuel path 3*a* is burned in a diffusion combustion so that a burning thereof is stable although a density of NOx is high. The fuel from the second step fuel path 3*b* is burned in a premixing combustion so that the density of NOx is low. The fuel from the first step fuel path 3*a* and from the start assisting fuel path 3*c* is used between a start of burning and a predetermined output of the burner. The fuel from the first step fuel path 3*a* and from the second step fuel path 3*b* is used between the predetermined output of the burner and a rated output thereof. In order to decrease the density of NOx, it is necessary that a rate of the fuel from the second step fuel path 3*b* for the premixing to an entire amount of the fuel is large and a rate of the entire amount of the fuel to the air supplied for the burning is small.

When the air-fuel mixture AF flows out of the swirler members 5 to be burned in the main burning chamber R1, the air-fuel mixture AF forms an eddy flow at the downstream side of the flame keeper 6 so that the shape of the flame is maintained by the eddy flow. Since the eddy flow starting point 6*c* of the steep expansion surface 6*b* is fixed with respect to the swirler members 5 and is spaced from the downstream ends of the swirler members 5 by a fixed sufficient distance, the flame burning in the main burning chamber R1 cannot move toward the eddy flow formed at the downstream ends of the swirler members 5. Therefore, the flame burning in the main burning chamber R1 is stable.

An angle of the tapered portion 6*a* may be changed variously. If the tapered portion 6*a* faces to the supplementary burning chamber R2, it is easy to transmit the flame in the supplementary burning chamber R2 to the main burning chamber R1 when the burning in the main burning chamber R1 is started. In any case, it is important that the eddy flow 8 is generated by the steep expansion surface 6*b*.

A root portion of a flexible seal 9 includes a cooling air path 10 to cool a reverse surface of the flame keeper 6. The cooling air flowing out of the flame keeper 6 is injected into the liner 2 without a contact with the eddy flow 8 so that the eddy 8 is not disturbed. A separating wall 11 guides the cooling air to effectively cool the flame keeper 6.

Figure 4:
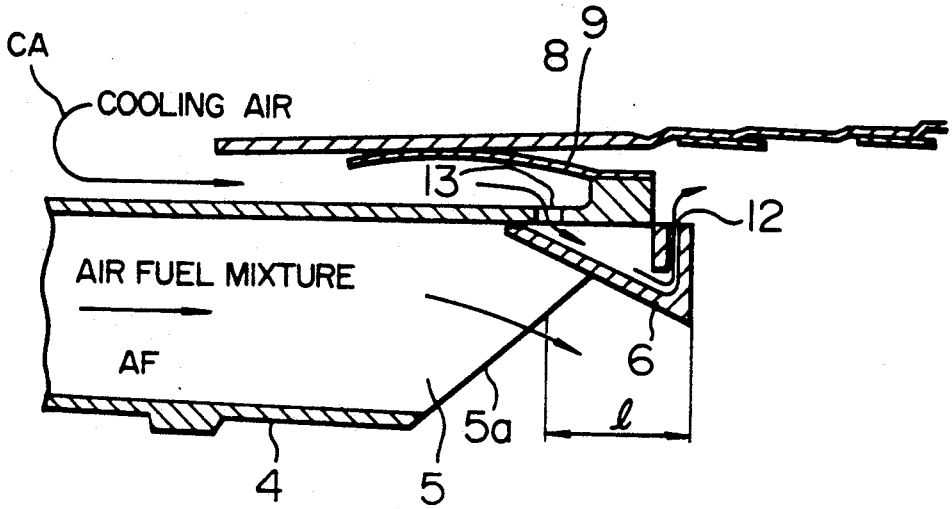
FIG. 4 is a cross-sectional view showing a part of another burner according to the present invention.
Figure 5:
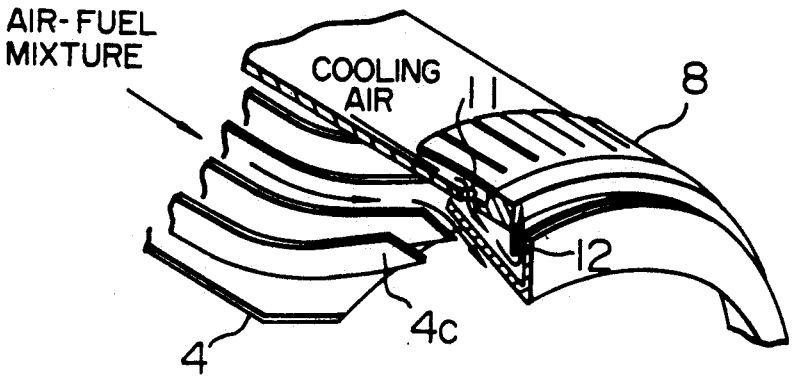
FIG. 5 is an oblique projection and partly-sectional view showing the burner of FIG. 4.

As shown in FIGS. 4 and 5, the flame keeper 6 may extend in the premix device 4. In this case, a distance l is formed between the steep expansion surface 6*b* of the flame keeper 6 and the downstream end surfaces 5*a* of the swirler members 5. Since the flow direction of the air-flow-mixture is changed in the premix device 4 with a high flow speed thereof before the mixture flows into the burning chambers, the air-flow mixture is effectively oriented radially inwardly by the premix device 4. A wall of the premix device 4 includes an air intake path 13 through which the cooling air flows into the flame keeper 6 to cool the flame keeper. A narrow clearance 12 is arranged at a reverse wall of the flame keeper 6 so that the flow speed of the cooling air is accelerated to obtain an effective cooling. The burner may include a plurality of the flame keepers 6 arranged longitudinally or radially.

Figure 6:
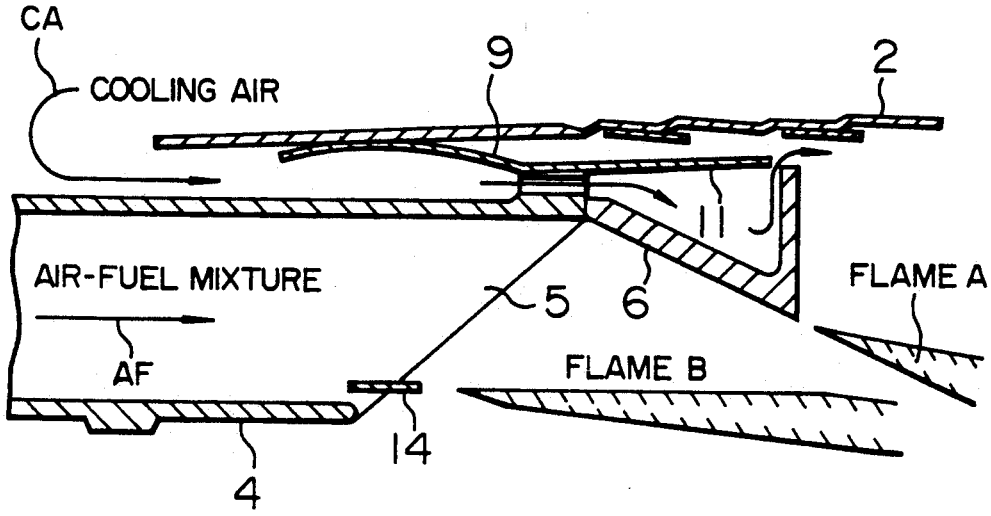
FIG. 6 is a cross-sectional view showing a part of another burner according to the present invention.
Figure 7:
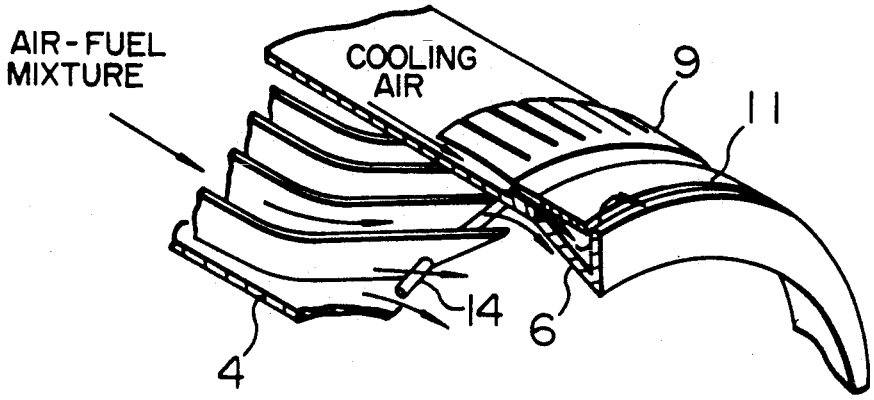
FIG. 7 is an oblique projection and partly-sectional view showing the burner of FIG. 6.

As shown in FIGS. 6 and 7, two of the flame keepers 6 and 14 are arranged longitudinally or radially. The flame keeper 14 is fashioned as a ring 14 and generates the eddy flow of the air-fuel mixture at the downstream end thereof to maintain a flame B. The flame keeper 6 also generates the eddy flow (FIG. 1) of the air-fuel mixture at the downstream end thereof to maintain a flame A. A distance is formed between the downstream end of the flame keeper 14 and the downstream end surfaces 5*a* of the swirl members 5. The burner may include a plurality of ring-shaped the flame keepers 14, and the flame keeper 14 may be V-shaped.

Figure 8:
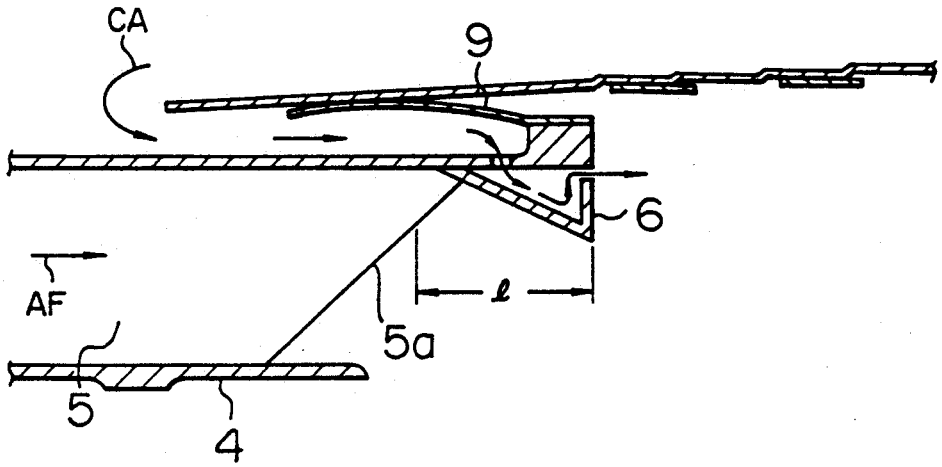
FIG. 8 is a cross-sectional view showing a part of another burner according to the present invention.

As shown in FIG. 8, the flame keeper 6 may be integrally mounted at the inside of the premix device 4. The swirler members 5 terminate with a clearance from a forward end of the premix device 4 so that the distance l is formed between the downstream end of the flame keeper 6 and the downstream end surfaces 5*a* of the swirler members 5. The shape of the flame keeper 6 may be changed variously, and the premix device 4 may have a cylindrical shape instead of an annular shape.

Figure 9:
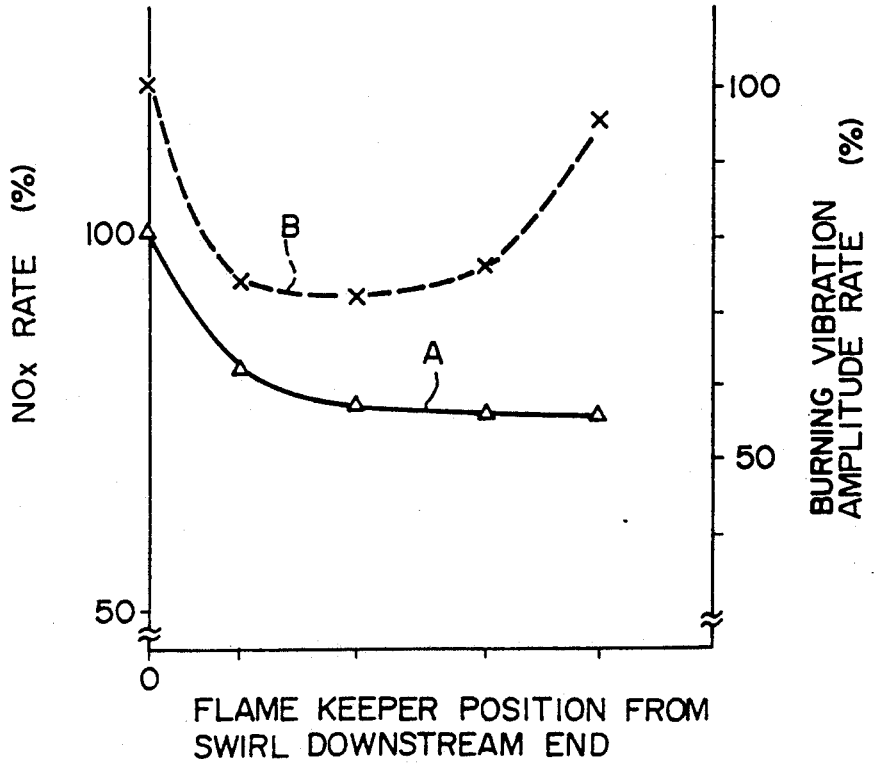
FIG. 9 is a graphical illustration of the relationship between a NOx density rate, a burning vibration amplitude rate, and a position of a flame keeper.

In FIG. 9, a NOx density rate is a rate of a NOx density by the burner according to the present invention to a NOx density by the conventional burner, a burning vibration amplitude rate is a rate of a vibration amplitude of the burner according to the present invention to a vibration amplitude of the conventional burner, and a position of a flame keeper is a distance between the downstream end of the flame keeper 6 and the downstream end surfaces 5*a* of the swirler members 5. In the conventional burner, the position of the flame keeper is 0. A line A represents an actual relationship between the position of the flame keeper and the NOx density rate, and a line B represents an actual relationship between the position of the flame keeper and the burning vibration amplitude rate. These actual relationships were measured when an outer diameter of the liner 2 is 350 mm and a height of the swirler members 5 is 22 mm. The larger the position of the flame keeper is, the smaller the NOx density rate and the burning vibration amplitude rate are. When the position of the flame keeper is 10 to 15 mm, the NOx density rate, the size of the burner is small and the operation of the burner is stable.

What is claimed is:

1. A burner comprising:

at least one premixing swirler member on which an air-fuel mixture passes prior to burning of the fuel, and at least one eddy generating device arranged in a flow of the air-fuel mixture to generate an eddy flow so that the eddy flow maintains a shape of a flame of the burned fuel, said at least one eddy generating device is fixedly spaced from a downstream end of the swirler member by a fixed sufficient distance so that a shape of the flame maintained by the eddy flow is prevented from moving toward the downstream end of the swirler member even with variation of temperature in the burner.

2. A burner according to claim 1, wherein the eddy generating device is longitudinally fixedly connected to the swirler member.

3. A burner according to claim 1, wherein a space is formed between the downstream end of the swirler member and the eddy generating device.

4. A burner according to claim 1, wherein the burner includes a plurality of the eddy generating devices arranged radially in the burner.

5. A burner according to claim 4, wherein the eddy generating device arranged at a most radially outward position generates the larger inner diameter of the eddy flow.

6. A burner according to claim 4, wherein inner diameters of the eddy flows formed by the respective eddy generating devices are different from each other so that outer diameters of the flames respectively maintained by the eddy flows are different from each other.

7. A burner according to claim 1, wherein the burner includes a cooling air path in the eddy generating device.

8. A burner according to claim 7, wherein cooling air of the cooling air path flows into a downstream side of the eddy generating devices after cooling the eddy generating device.

9. A burner according to claim 1, further comprising means for causing a air-fuel mixture to pass on said at least one premixing swirler member.

10. A gas turbine comprising:

at least one premixing swirler member on which an air-fuel mixture passes prior to burning of the fuel, at least one eddy generating device arranged in a flow of the air-fuel mixture to generate an eddy flow so that the eddy flow maintains a shape of a flame of the burned fuel, said at least one eddy generating device is fixedly spaced from a downstream end of the swirler member by a fixed sufficient distance so that the shape of the flame maintained by the eddy flow is prevented from moving toward the downstream end of the at least one swirler member even with variation of temperature in the burner, and gas turbine vanes driven by a gas generated from the burned fuel.

11. A gas turbine according to claim 10, further comprising means for causing an air-fuel mixture to pass on said at least one premixing swirler member.

* * * * *